United States Patent [19]

Brackmann et al.

[11] 4,222,397

[45] Sep. 16, 1980

[54] OPENING AND MOISTENING TOBACCO FROM BALES

[75] Inventors: Warren A. Brackmann, Cooksville; Albert Kuhner, Schomberg, both of Canada

[73] Assignee: Rothmans of Pall Mall Canada Limited, Toronto, Canada

[21] Appl. No.: 951,655

[22] Filed: Oct. 16, 1978

[30] Foreign Application Priority Data

Oct. 18, 1977 [GB] United Kingdom ..... 43372/77

[51] Int. Cl.[3] ..... A24B 3/06

[52] U.S. Cl. ..... 131/138 R; 131/140 R

[58] Field of Search ..... 131/133 R, 133 A, 134, 131/135, 136, 138, 140 R, 140 A, 145, 146, 149, 120

[56] References Cited

U.S. PATENT DOCUMENTS

| | | | |
|---|---|---|---|
| 3,357,437 | 12/1967 | Maguire | 131/136 |
| 3,494,367 | 2/1970 | Maguire | 131/136 |
| 3,838,698 | 10/1974 | Dickinson | 131/136 |

*Primary Examiner*—V. Millin

*Attorney, Agent, or Firm*—Sim & McBurney

[57] ABSTRACT

Bales of tobacco are moistened and opened by impinging steam onto one end face of a tobacco bale to cause penetration of steam into the face and removing tobacco from the moistened face. The bale is located on a horizontal surface with the grain of the tobacco layers extending vertically and from one end face to the other. The tobacco is removed from the moistened end face by forces acting transverse to the face perpendicularly to the grain.

13 Claims, 5 Drawing Figures

OPENING AND MOISTENING TOBACCO FROM BALES

The present invention is directed to the continuous opening and moistening of tobacco from bales. The term "bale" applies particularly to blocks of compressed layers of threshed tobacco of approximately rectangular cross-section but is also intended to include blocks of circular or different cross-sections, for example, and which are commonly termed "hogsheads", and bales of whole tobacco leaf.

BACKGROUND TO THE INVENTION

Tobacco bales require to be broken up or opened for processing of the tobacco into desired products. The bales are generally comparatively dry and the tobacco must be premoistened to inhibit degradation of the tobacco on bale opening.

A number of commercial systems are known for the premoistening of tobacco bales for later separation of the layers of premoistened tobacco. These are batch operations effected on a bale or a number of bales using steam as the moistening agent.

There is also one commercial continuous process described in U.S. Pat. No. 3,838,698. In this patent, there is described a method and apparatus for the continuous moistening and opening of tobacco in which a rectangular bale is constantly urged towards an opening and moistening zone and is impaled on a straight hollow probe extending in the direction of movement of the bale. The probe has openings through which vacuum is applied to draw steam provided as an ambient atmosphere in the opening and moistening zone into the front face of the bale. Rotary doffers are located in the opening and moistening zone and engage the front face of the bale to remove therefrom tobacco which is moistened by the steam. This prior art procedure is commonly termed the "Dickinson System".

In the Dickinson system, the bales are oriented with the grain located horizontally and extending from end to end and the rotary doffers are mounted for rotation about horizontal parallel axes.

The Dickinson System has the distinct advantages over the batch systems that the tobacco is opened after moistening in the same unit and the process can be stopped at any time so as to tailor the flow of treated tobacco to that desired.

The Dickinson System suffers from a number of drawbacks. For example, to operate efficiently in moistening the tobacco, a considerable vacuum must be applied to the probe, requiring a high powered motor to drive the vacuum pump, typically about 40 h.p. Small tobacco particles are drawn through the openings in the probe under the influence of the vacuum, requiring the separation of these particles from the vacuum line before entering the pump.

Another problem with the Dickinson System is that equipment is necessary to rotate the probe to prevent clogging of the openings by tobacco particles and thereby impairing the ability to apply vacuum to the interior of the block. This rotation often is insufficient to prevent clogging. Power is consumed in the Dickinson System in the effort of moving the bale forwardly against the probe.

Additionally, probe bending is sometimes observed and, if this condition is not detected and corrected soon enough, the probe may break off. Further, a vacuum seal is required around the bale, which limits the shape of tobacco bales which can be treated.

SUMMARY OF INVENTION

In accordance with the present invention, an improved continuous tobacco premoistening and opening system is provided which maintains the advantages of continuous operation and simultaneous premoistening and opening while minimizing the disadvantages of the Dickinson System. In this invention, the probe with its attendant problems is omitted entirely, the vacuum pump motor power requirements are considerably diminished and the necessity to achieve a vacuum seal is eliminated. The procedure of the present invention also produces moistened and opened tobacco of better quality than is conventionally produced using the Dickinson system.

In accordance with the present invention, the tobacco bale is oriented with the grain located vertically and extending from end to end, steam is impinged on the leading end face to cause penetration into the bale and tobacco is removed from the leading end face.

Preferably, the tobacco bale is fed horizontally for the impingement of steam and tobacco removal operations, since this orientation is the most convenient for processing.

DESCRIPTION OF PREFERRED EMBODIMENT

Figure 1:
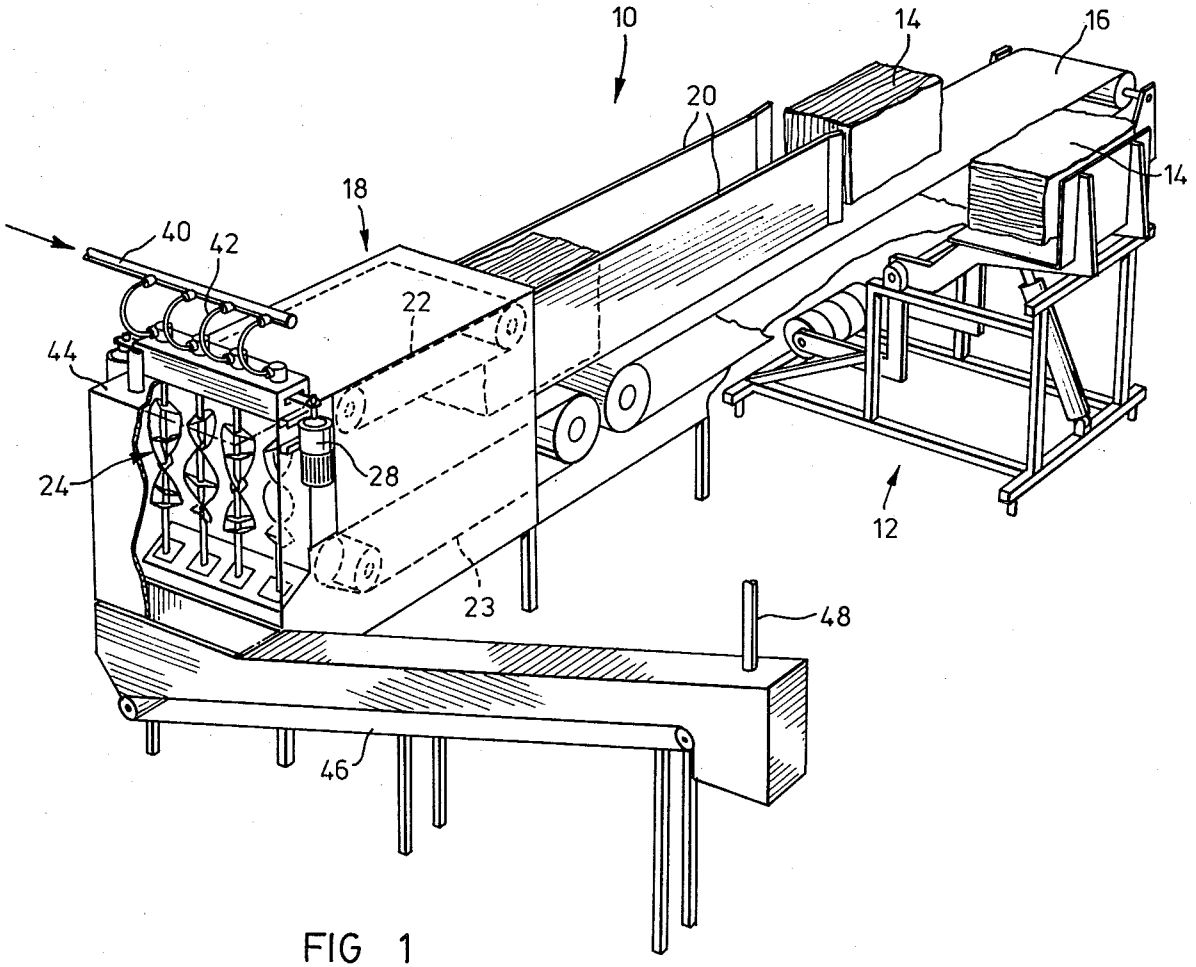
FIG. 1 is a perspective view of an apparatus for effecting continuous premoistening and opening of tobacco bales in accordance with one embodiment of the invention.

Referring first to FIGS. 1 to 4 of the drawings, which illustrate the presently-preferred embodiment of the apparatus for effecting the process of the invention, an apparatus 10 for continuous premoistening and opening of tobacco bales includes a bale loader and orienter 12 for loading tobacco bales 14 onto the upper surface of a conveyor belt 16. When tobacco bales are removed from their outer storage wrapping they usually have their grain (i.e. the layers of compressed tobacco leaves) extending horizontally, and the loader 12 orients the bale 14 so that the grain extends vertically. Where the bale 14 is available in the correct orientation for placement on the conveyor 16, the loader-orienter 12 may be omitted.

It is essential to the proper premoistening and opening of tobacco in accordance with this invention for the grain in the bale to be vertical and for the grain to extend from end to end, so that the grain is exposed at the ends. Opening efficiency is considerably diminished if the grain is located horizontally or if the bale is oriented with the grain extending from side to side, so that a tobacco layer is exposed at the ends.

The conveyor belt 16 extends horizontally to a processing chamber 18, guide walls 20 being associated with the conveyor belt 16 upstream of the processing chamber 18 to maintain the bales 14 in the desired alignment during feed to the processing chamber 18.

The processing chamber 18 in its upstream zone includes an upper conveyor belt 22 which cooperates with a lower conveyor belt 23 to grip the bales 14 and feed them to the downstream zone of the processing chamber 18.

Generally, the conveyor belt 16 moves slightly faster than the upper and lower belts 22 and 23 to allow bales to be fed to the processing chamber 18 from the upstream end of the belt 16 while one or more bales is already positioned in the processing chamber 18. The bales 14 in the processing chamber 18 move forward at the rate of the upper and lower belts 22 and 23.

At the downstream end of the processing chamber 18 are located a plurality of conditioning and opening doffer elements 24. Each of the doffer elements 24 is mounted for rotation about its vertical axis.

Four doffer elements 24 are illustrated in the embodiment of FIGS. 1 to 4 and this number is chosen for convenience. Any desired number may be chosen depending on the individual size of the doffer elements 24 and the dimension of the bales 14 to be processed by the apparatus.

Figure 3:
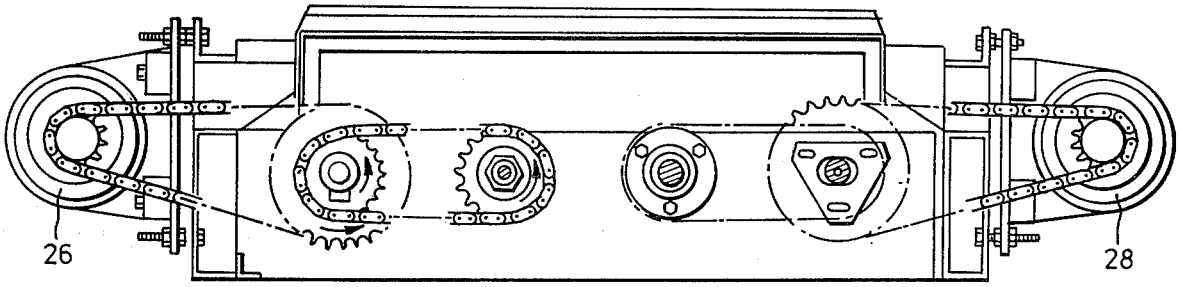
FIG. 3 is a partial sectional view taken on line 3—3 of FIG. 2 illustrating the drive mechanism for the doffers.
Figure 2:
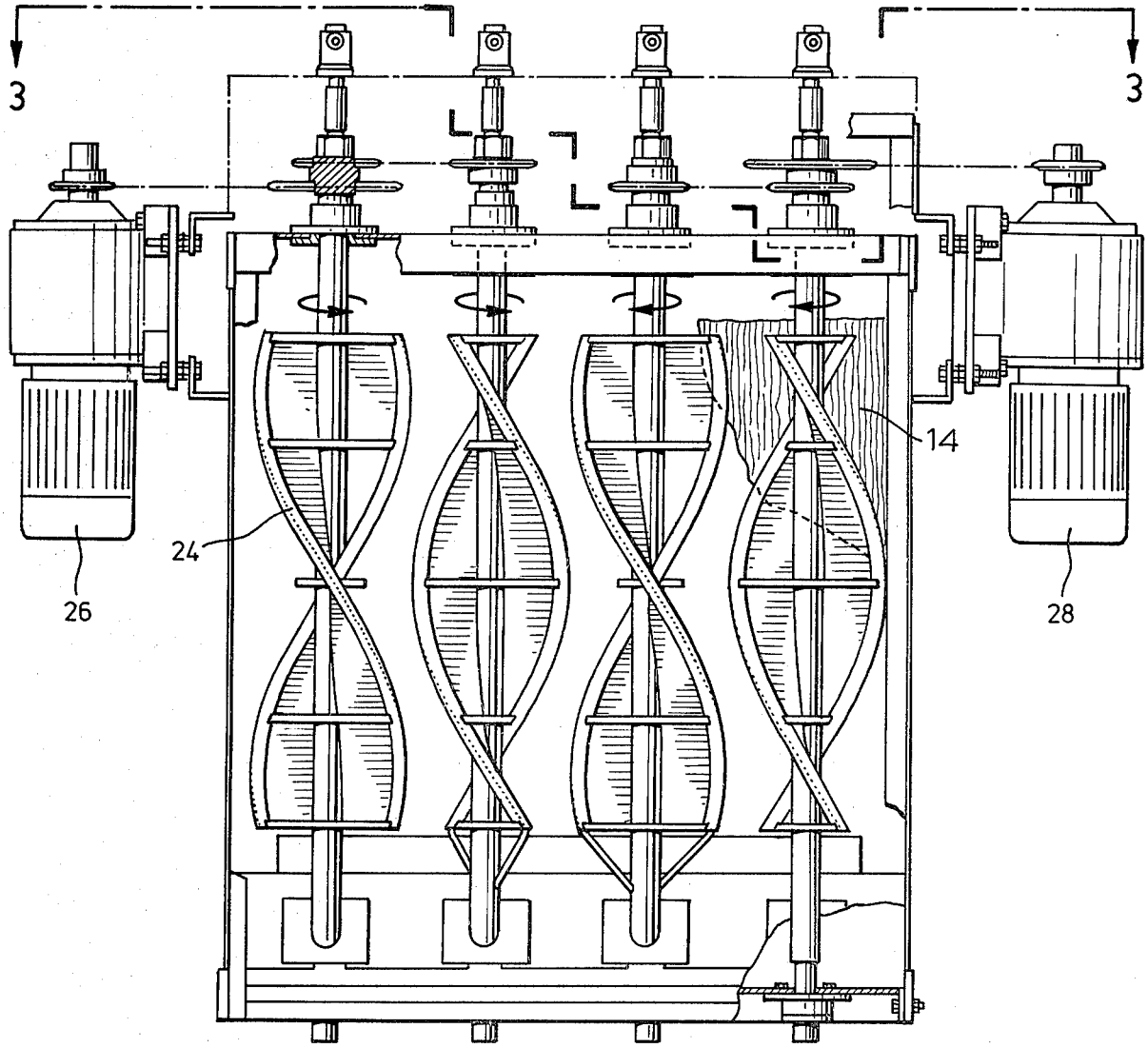
FIG. 2 is an elevational view of the doffers used in the apparatus of FIG. 1.

The four doffer elements 24 are driven in pairs by two separate drive motors 26, 28 through suitable gearing and chains as shown in FIG. 3 so that the left-hand pair of doffer elements 24 brush tobacco towards the left side while the right-hand pair of doffer elements 24 brush tobacco towards the right-hand side. The doffer elements 24 are driven in this way to provide an efficient opening motion with respect to the tobacco.

Figure 4:
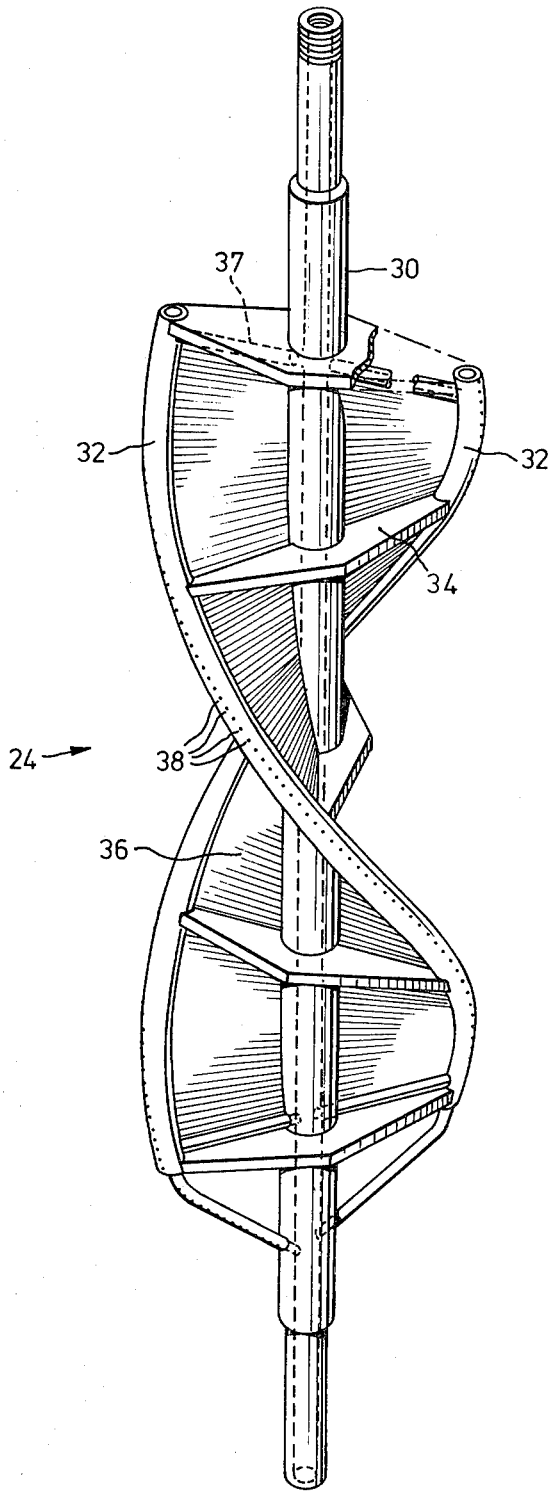
FIG. 4 is a perspective view of a doffer used in the apparatus of FIG. 1.

As may be seen in detail in FIG. 4, each doffer element 24 comprises a hollow axle member 30 and two hollow tubular members 32 spaced from and mounted to the axle member 30 by suitable spacers 34 and webs 36. Fluid flow communication between the axle 30 and the tubular members 32 is achieved by suitable connections 37.

Each of the hollow tubular members 32 is helically directed with respect to the axle member 30 and is equally spaced from the axle member 30 throughout its length. The helical arrangement permits a constant driving force to be applied, although other shapes may be used, if desired.

A plurality of radially-directed closely spaced openings 38 is provided in each of the tubular members 32 to permit steam jets to be projected therefrom. A steam manifold line 40 is provided from which individual steam feed lines 42 extend to the individual doffer elements 24. Steam fed to the processing chamber 18 engages the front end face of the tobacco bale 14 by impingement from the openings 38.

The openings 38 preferably are positioned with respect to the contact point of the tubular members 32 with the front face of the tobacco bale 14 so that the impingement is a direct injection of the steam, resulting from engagement between the openings 38 and the tobacco face.

An openable end door 44 encloses the processing chamber 18. The door 44 has an open lower end to permit premoistened and opened tobacco to fall onto a conveyor 46 for transportation to further processing to the desired tobacco product. A steam vent pipe 48 is provided for removal of excess steam, for example, using a fan.

OPERATION

In operation of the embodiment of FIGS. 1 to 4, a bale of tobacco 14 is continuously moved forward in the processing chamber 18 against the rotating doffer elements 24 from which steam jets project. As each individual portion of the tubular members 32 engages the tobacco bale face, steam jets impinge upon and enter the surface substantially perpendicularly thereto. At the same time, the transverse wiping action of the tubular member removes tobacco from the surface.

By injecting steam into the front face of the tobacco, the steam is able to penetrate between the bale lamina and moistens the tobacco sufficiently that the doffer opening action does not significantly degrade the tobacco.

The penetration achieved by the steam is several times greater than the depth of tobacco removed from the front face of the bale by each engagement of the doffer element 24. The penetration of any given bale by the steam is a function of steam velocity, the rate of tobacco feed and the density of the bale, and varies widely, such as, up to about 6 inches (15 cm.). Therefore, the tobacco which is being removed by the doffer elements 24 is already premoistened from several previous passes.

The precise positioning of the steam jet openings 38 with respect to the curvature of the tubular members 32 may be varied to provide perpendicular steam jet impingement immediately prior to, immediately after or precisely at engagement of the tubular member 32 with the tobacco bale 14. The steam jet openings 38 may vary in location up to about 20° from the contact point.

In the illustrated embodiment of FIGS. 1 to 4, the steam flows through the jet openings 38 irrespective of the location of the doffer element 24 in its rotation. Steam economy may be effected by suitable control of the steam flow so that steam passes through the openings 38 only when the particular tubular member 32 is adjacent the tobacco face.

Since steam is injected into and penetrates the end face of the tobacco bale, high vacuum is not required to draw steam through the front face to achieve the desired moistening, in contrast to the Dickinson system where such vacuum is essential.

With the elimination of the vacuum, the probe used in the Dickinson system, along with its associated problems and power requirements, is eliminated, as is the necessity to provide vacuum sealing around the bale. The latter is significant in that the Dickinson system is limited to the use of rectangular whole bales, whereas the present invention is not so limited and may apply to any shape bales, including bales which have partially broken apart.

The system of this invention produces moistened and opened tobacco on a continuous basis. The system is readily started up and shut down to produce tobacco from bales as and when required.

The tobacco quality obtained, in terms of residual "hard spots", i.e. hard clumps of unopened or insufficiently moistened tobacco and of the presence of fines in the product, has been found to be superior to the quality of tobacco produced by the Dickinson system and also to the quality of tobacco product by any of the conventional batch systems mentioned above, after opening.

The orientation of the doffers and the grain of the bale differs in this invention, where both are vertical, from the Dickinson system, where both are horizontal. This difference contributes to easier opening and the lower incidence of fines experienced in this invention.

DESCRIPTION OF ALTERNTIVE EMBODIMENT

Figure 5:
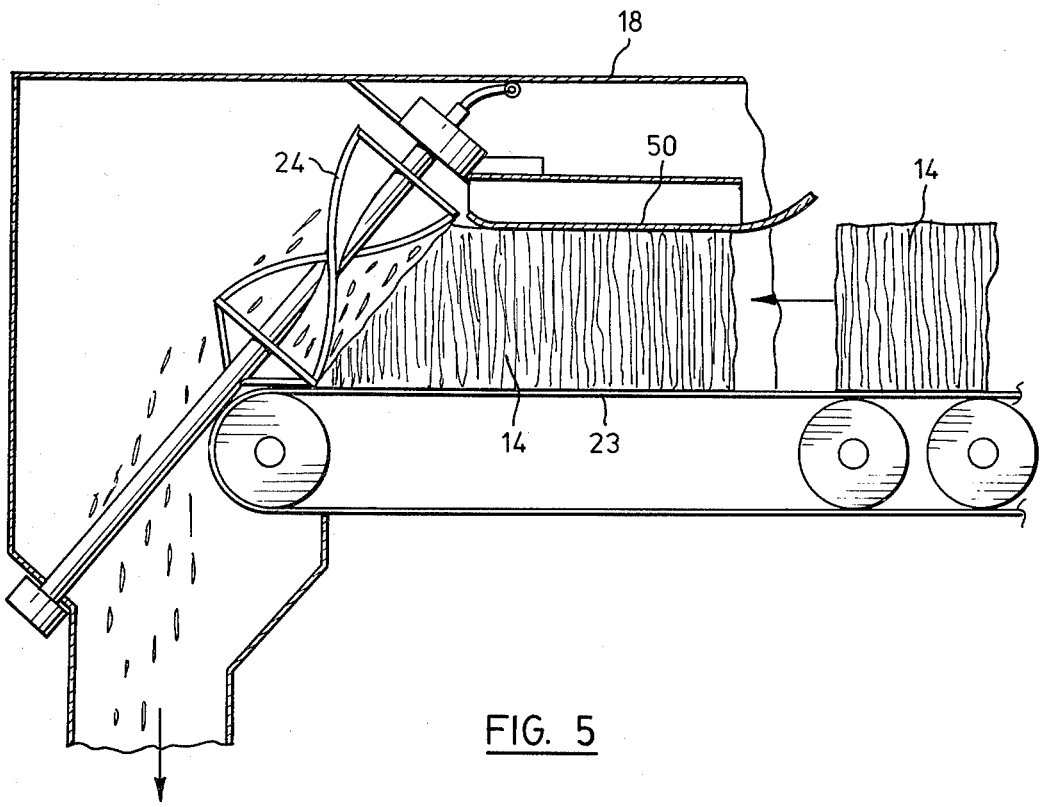
FIG. 5 is a schematic sectional view of an apparatus provided in accordance with a second embodiment of the invention.

Turning now to FIG. 5, there is illustrated therein an alternative embodiment of the invention, wherein like reference numerals to those used in FIGS. 1 to 4 are used to designate like parts. The doffer elements 24 are inclined inwardly of the processing chamber 18 so that the leading surface of the bale 14 assumes an inclined form and the surge of incompletely conditioned tobacco resulting from bale end collapse associated with the upright orientation of the doffers of FIGS. 1 to 4 is eliminated.

In place of the upper drive belt 22, there is used a guide plate 50 and positive feed of the bale 14 is achieved using the lower drive belt 23, which may be augmented by an upper roller used in place of the guide plate 50.

EXAMPLE

The apparatus of FIGS. 1 to 4 was tested for treatment of conventionally-sized rectangular threshed tobacco bales. The conveyor band feed rate was 90 mm per minute within the processing chamber 18 and the doffer rotational speed was 70 rpm. The tobacco obtained was tested, and the results are reproduced in the following table:

| Property | Initial Bale | Tobacco Product |
|---|---|---|
| Moisture | 12.9 wt. % | 18.7 wt. % |
| Temperature | ambient (° C.) | 70° C. |
| Hard Spots | — | None in 1350 lbs (600 Kg) of processed tobacco |
| Steam Consumption | — | 0.16 lb steam/lb tobacco |
| Steam Efficiency (% condensed on tobacco) | | 42% |

SUMMARY OF THE DISCLOSURE

The present invention, therefore, provides process and apparatus for premoistening and opening tobacco which is superior to prior art systems. Modifications are possible within the scope of the invention.

What we claim is:

1. A method of premoistening and opening tobacco in bales, which comprises:

feeding a bale of tobacco with its grain oriented substantially vertically and with the grain extending from the forward to rear faces of the bale, impinging steam on the forward face of said bale to cause penetration of steam into the forward face, and removing tobacco from the forward face of the bale.

2. The method of claim 1 wherein said steam impingement is effected from steam ejecting openings in tobacco removal means substantially simultaneously effecting said removal of tobacco and said steam penetrates the forward face of the bale to a depth exceeding the depth of tobacco which is removed from said forward face.

3. A method of premoistening and opening tobacco in bales, which comprises:

feeding a bale of tobacco with its grain oriented substantially vertically and with its grain extending from the forward to rear faces of the bale, impinging steam on the forward face of said bale to cause penetration of steam into the forward face, and removing tobacco from the forward face of the bale by the application of a tobacco-removing force generally perpendicularly to said grain and across said front bale face.

4. The method of claim 1, 2 or 3 wherein said steam impingement is effected generally perpendicularly to the forward bale face and generally coplanarly with said bale grain.

5. The method of claim 4 wherein said steam impingement is effected by direct injection of steam into the forward bale face from face-engaging steam-ejecting openings.

6. A continuous method for the conditioning of tobacco in bales, which comprises:

continuously feeding a succession of tobacco bales horizontally with the grain in each bale oriented substantially vertically and with the grain extending from a forward to a rear face of the bale, continuously subjecting the forward face of the succession of bales to the impingement of a plurality of steam jets to cause penetration of steam into the forward face and moistening of tobacco therein, and continuously removing moistened tobacco from said forward face by the application of tobacco removal forces generally transverse to the leading face and generally perpendicular to the bale grain substantially simultaneously with said steam jet impingement, said steam penetration into said forward face exceeding the depth of tobacco removed therefrom by said transverse forces.

7. The method of claim 6, wherein said steam jets are arranged in a plurality of groups, each group being provided in a plurality of vertically-extending helically-directed rows rotating about a substantially vertical axis located parallel to said bale grain.

8. The method of claim 6 or 7, wherein said impingement is effected by direct injection of steam into the forward bale face.

9. An apparatus for premoistening and opening tobacco in bales, comprising:

means defining a conditioning chamber, horizontal conveyor means for continuously advancing a succession of bales of tobacco towards and into the conditioning chamber, a plurality of tobacco removal means mounted in said conditioning chamber for continuously removing tobacco from the leading face of the bale in the conditioning chamber, and steam impingement means structurally integral with and structurally forming part of said tobacco removal means for impinging steam on said leading face to cause penetration of steam therein.

10. An apparatus for premoistening and opening tobacco in bales, comprising:

means defining a conditioning chamber, horizontal conveyor means for continuously advancing a succession of bales of tobacco towards and into the conditioning chamber, tobacco removal means mounted in said conditioning chamber for continuously removing tobacco from the leading face of the bale in the conditioning chamber, said tobacco removal means comprising a plurality of horizontally-spaced rotary doffers mounted for rotation about parallel vertical axes and having hollow helically-directed tubular tobacco-engaging members for said tobacco removal, and steam impingement means forming part of said tobacco removal means for impinging steam on said leading face to cause penetration of steam therein, said steam impingement means comprising a plurality of closely spaced openings in said hollow tobacco-engaging members for formation of steam jets.

11. The apparatus of claim 10 wherein said openings extend generally radially of said tobacco-engaging members.

12. The apparatus of claim 9, 10 or 11 including tobacco bale positioning and orientation means adjacent said conveyor means and spaced from said conditioning chamber for placing successive bales of tobacco on said conveyor means with the grain of said bale oriented vertically and extending from end to end.

13. The apparatus of claim 9, wherein said plurality of tobacco removal and steam impingement means comprises rotatable tobacco removal means mounted about parallel vertical axes for engagement with the leading face of said tobacco bales and a plurality of closely spaced steam ejecting openings in said rotatable means for effecting said steam impingement on said leading face.

* * * * *